US006148753A

United States Patent [19]

Shore

[11] Patent Number: 6,148,753

[45] Date of Patent: Nov. 21, 2000

[54] RECONFIGURABLE FORESAIL

[76] Inventor: William A. Shore, 139 Harrison Ave., Newport, R.I. 02840

[21] Appl. No.: 09/346,832

[22] Filed: Jul. 2, 1999

[51] Int. Cl.[7] ..... B63B 35/00

[52] U.S. Cl. ..... 114/102.22; 114/39.11

[58] Field of Search ..... 114/102.12, 102.18, 114/102.22, 102.3, 102.32, 102.33, 39.11

[56] References Cited

U.S. PATENT DOCUMENTS

| | | | |
|---|---|---|---|
| 2,620,760 | 12/1952 | Melges | 114/102.22 |
| 2,858,789 | 11/1958 | Stearns | 114/102.12 |
| 3,730,124 | 5/1973 | Britton | 114/106 |
| 3,828,711 | 8/1974 | Russell | 114/102.33 |
| 5,894,807 | 4/1999 | Aiken | 114/39.11 |

*Primary Examiner*—S. Joseph Morano
*Assistant Examiner*—Andrew D. Wright
*Attorney, Agent, or Firm*—Robert K Tendler

[57] ABSTRACT

A system is provided for changing the shape of a foresail from a spinnaker shape to a Genoa shape through the utilization of a tensioning line which runs from the head of the spinnaker shaped sail to its tack. Tensioning of this line provides that the flap of material forward of the tensioning line folds back over the leeward side of the foresail, where differential pressure across the luff created by the tensioning line sucks the loose flap of material in towards the sail, such that it lays flat against the leeward side of the sail. The reshaping permits the use of the sail to within 50 degrees of the wind, thus allowing the use of one sail for wind conditions which would normally require two or more sails.

11 Claims, 4 Drawing Sheets

RECONFIGURABLE FORESAIL

FIELD OF INVENTION

This invention relates to sail configurations and more particularly to a system for providing a reconfigurable foresail.

BACKGROUND OF THE INVENTION

As will be appreciated, sails for use in sailing vessels are configured to accommodate different wind conditions. For instance, when a vessel is running with the wind, it is typical to provide as a foresail, a spinnaker which is either full cut or asymmetrically cut. The purpose of the spinnaker is to drive the vessel forward at maximum speed by catching the wind which is coming from astern or abaft the beam. In this sailing condition, the vessel is said to be running either dead down wind or on a broad reach. Spinnakers are most useful in these types of wind conditions, but are also useful, depending on the wind velocity, for beam reaches in which the wind is coming perpendicular to the beam of the vessel.

However, running or reaching, one wishes to come into the wind, such as for tacking purposes, then the apparent wind direction changes from a beam reach at 90 degrees to as little as 28 degrees for genoa jibs, which are properly configured and set. When the vessel either changes direction or the wind changes direction relative to the vessel, sail changes are required, especially the foresail, in order to adapt to the changing wind condition. The result is that a spinnaker, if used, needs to be doused, and a genoa jib or other jib raised, to accommodate a change from a downwind run or reach to a position where the vessel is hard on the wind. Sail changes are tedious and time consuming, and require a number of foredeck personnel to effectuate the change. The change is accompanied by the un-attaching and re-attaching of jib sheets, guys and halyards. The inconvenience of sail changing not only affects the cruising sailor, but also is critical in sailboat racing.

More particularly, with respect to sail vessel racing, the racing rules sometimes specify that only a limited number of sails may be carried for a particular race. It is therefore desirable to have the ability to be able to effectuate a sail change by reshaping the sail that is already up, so as to be within the rules for the particular race.

Additionally, in order to assist in simplifying the flying of a spinnaker, so-called asymmetric spinnakers have been developed, sometimes called genakkers, in which the tack of the sail is fixed to a bowsprit or boom ahead of the vessel, with the sail being hoisted by a halyard at the head of the sail, and with the jib sheet being attached to the clew of the sail. When running with the wind, these asymmetric spinnakers billow forwardly of the vessel and provide a large amount of sail presented to the wind to drive the vessel hard. This provides full performance at broad wind angles and limited apparent wind speed, which is the wind speed on the sail while the vessel is sailing. These asymmetric spinnakers are effective running down wind or on broad reaches, and are still somewhat effective at beam reaches. However, the vessel cannot be made to point closer than about 90 degrees to the wind before the leading edge or luff of the sail begins to collapse and drive is lost. It is at this apparent wind angle of about 90 degrees that the asymmetric spinnaker is doused in favor of a traditional genoa jib or working jib, thus requiring a sail change as the vessel rounds up into the wind.

It is therefore desirable to have a system which permits a single sail to be used in a wide variety of wind conditions, from running with the wind, all the way to a close reach.

SUMMARY OF THE INVENTION

In the subject invention, a spinnaker is re-configured with a tensioning line carried in a sleeve or pocket in the sail between the head and its tack, such that when tension is provided on the line, the sail is reconfigured from an asymmetric spinnaker shape to a genoa shape. After tensioning, the material ahead of the tensioning line folds back against the leeward side of the sail and rests flat thereagainst. The resultant sail shape is that of a flattened spinnaker, or more particularly, a traditional jib shape. The sail size is reduced by pulling on the tensioning line, which causes the luff of the sail to fold back behind the tensioned portion of the sail, making the sail smaller and flatter. As the sail becomes smaller and flatter, it is able to sail at less broad angles, eg. higher into the wind, and at higher apparent wind speeds. In one embodiment, the spinnaker made smaller and flattened by the tensioning line has been effective to apparent wind angles as small as 50 degrees. When the tension is removed from the tensioning line, the sail blossoms back to its original size and shape, thus making one sail do the job of two or more sails, without a sail change.

As an alternative embodiment, the tensioning line, rather than being led from the head of the sail to its tack, is led from the head of the sail, a predetermined distance aft of the luff of the sail, with the end of the sleeve opposite the head of the sail, a predetermined distance aft of the tack. This further reduces the size of the sail to accommodate freshening wind conditions, with the sail still providing drive to windward. Again, releasing the tensioning line brings the sail back to its full mode of operation.

It is a finding of this invention that unexpectedly, the loose portion of the luff ahead of the tensioned line lays sucked to the leeward portion of the foresail, where it is effectively stowed, and does not significantly effect the aerodynamic flow of the wind across the smaller, flattened sail. Thus, the drive capabilities of a sail, provided with a tensioning line are not materially affected by the loose luff flap as it lays against the leeward portion of the sail.

In summary, a system is provided for changing the shape of a foresail from a spinnaker shape to a Genoa shape through the utilization of a tensioning line which runs from the head of the spinnaker shaped sail to its tack. Tensioning of this line provides that the flap of material forward of the tensioning line folds back over the leeward side of the foresail, where differential pressure across the luff created by the tensioning line sucks the loose flap of material in towards the sail, such that it lays flat against the leeward side of the sail. The reshaping permits the use of the sail to within 50 degrees of the wind, thus allowing the use of one sail for wind conditions which would normally require two or more sails.

BREIF DESCRIPTION OF THE DRAWNGS

These and other features of the Subject Invention will be better understood in connection with the Detailed Description in conjunction with the Drawings of which:

Figure 4:
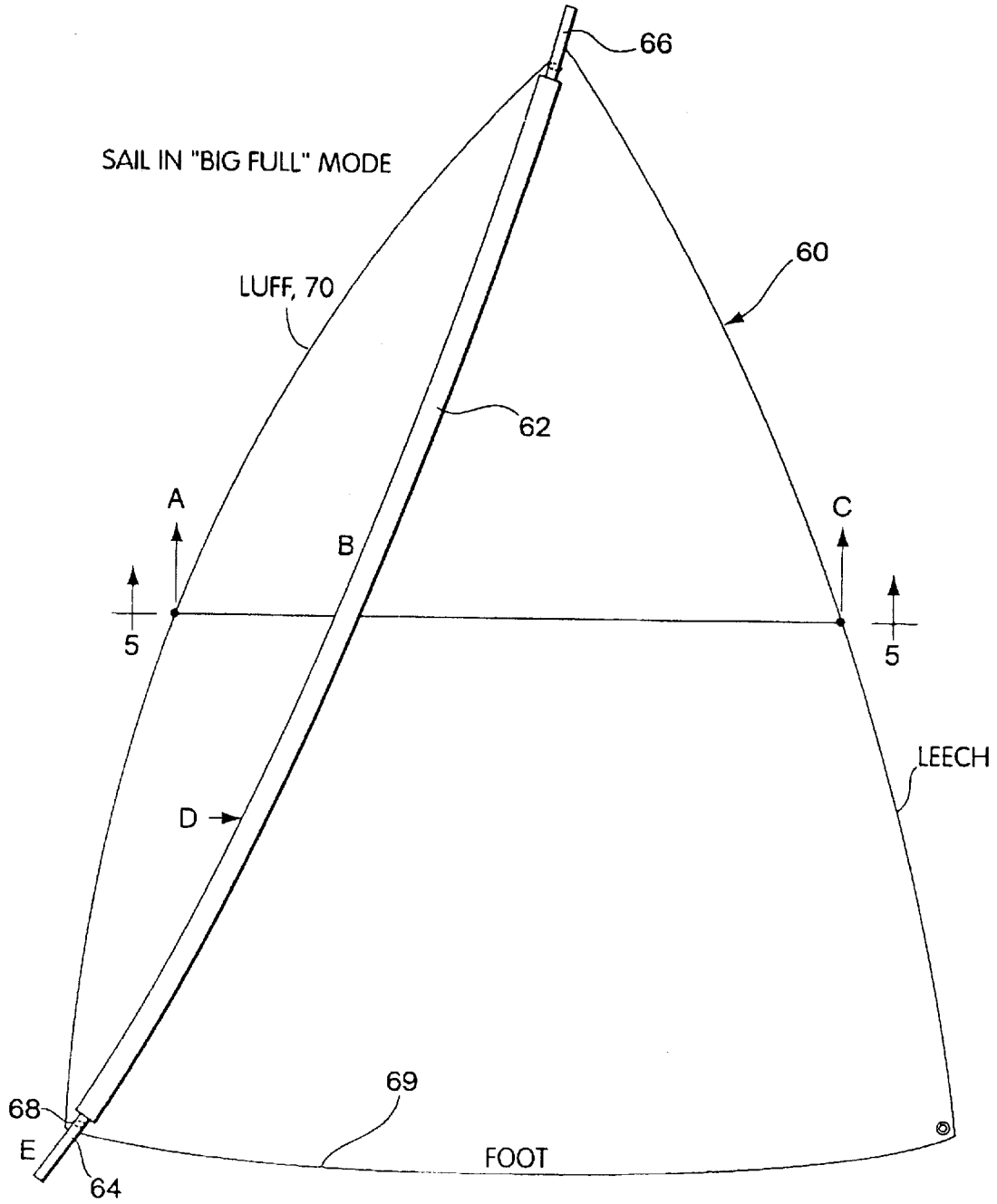
FIG. 4 is a diagrammatic illustration of a spinnaker, illustrating a sleeve in the sail carrying a tensioning line running between the head of the sail and the tack thereof.
Figure 6:
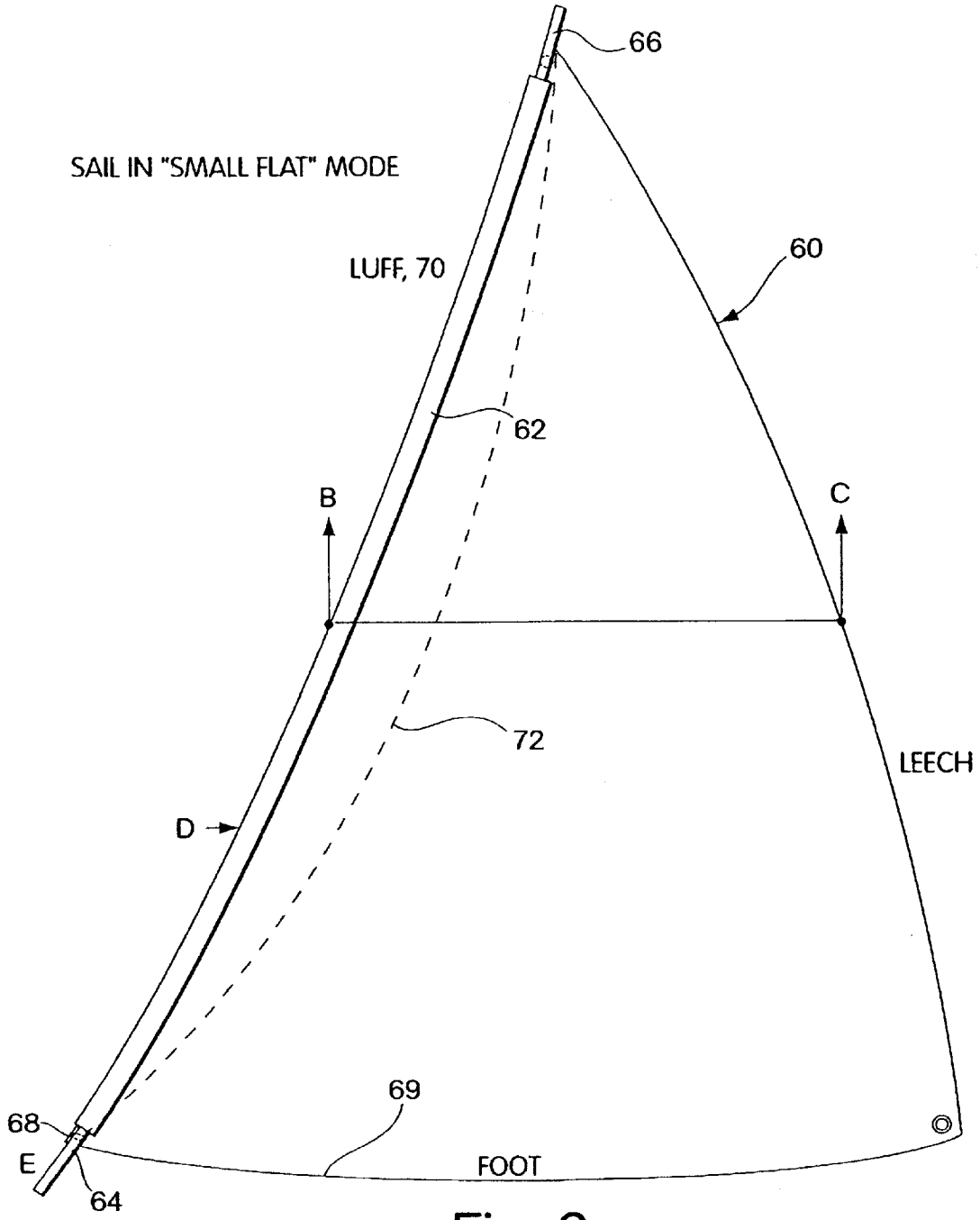
Figure 7:
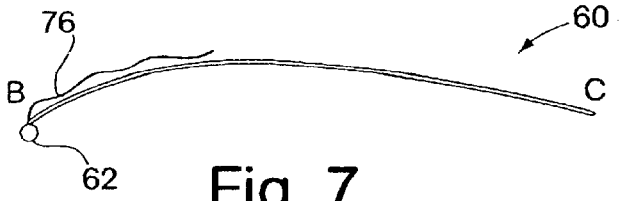

FIG. 6 is a diagrammatic illustration of the sail of FIG. 4, illustrating its shape upon tensioning of the tensioning line between the head and the tack of the sail, also illustrating in dotted outline, the folding back of the original luff of the sail along the leeward side of the sail; and, FIG. 7 is a cross-sectional view of the sail of FIG. 6 taken along the lines of B–C, illustrating the folding back of the original luff of the sail along the leeward side of the sail, where it is held in place adjacent the leeward side of the sail by aerodynamic forces.

DETAILED DESCRIPTION

Figure 1:
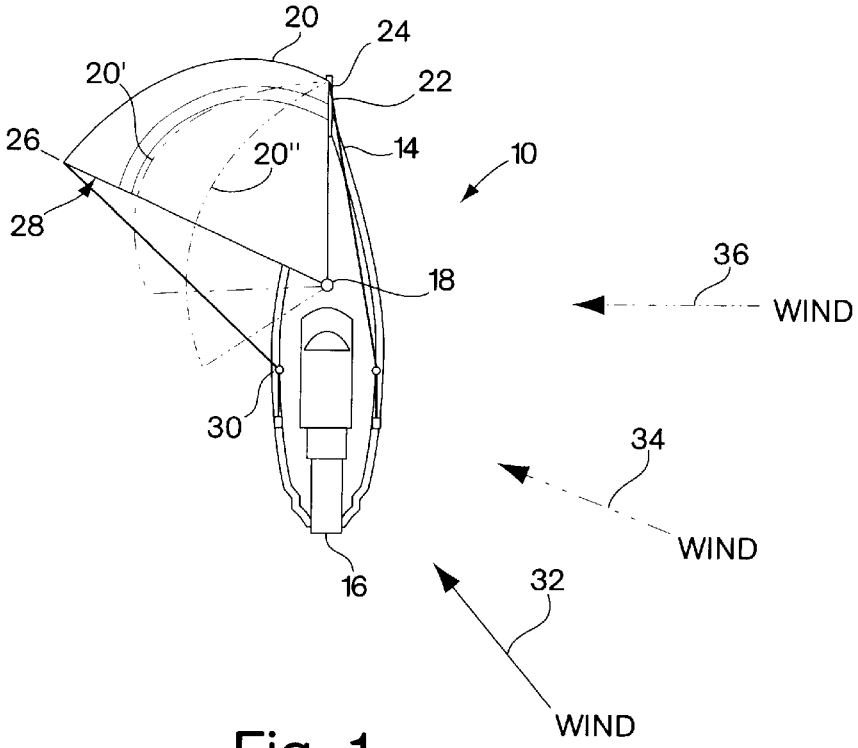
FIG. 1 is a schematic illustration of a vessel flying a spinnaker, with the spinnaker position based on the apparent wind direction.

Referring now to FIG. 1, a diagram is shown of a vessel 10 having a bow 14, a stern 16, and a mast 18 from which a spinnaker is flown. The spinnaker is hoisted up the mast at its head (not shown in this figure), and is secured to a bowsprit or forwardly projecting pole 22 from the bow 14 of vessel 10 at the tack 24 of the sail. The clew 26 of the sail is pulled in by a sheet 28 to a winch 30 or other cleating device on vessel 10, such that with an apparent wind direction 32, the sail is out in front of the vessel and full. Wind direction 32 corresponds to a broad reach. When the apparent wind direction shifts, as indicated by dotted arrow 34, sail 20 is repositioned by sheet 28 to the position 20' to accommodate the change in apparent wind angle. As illustrated by dotted arrow 36, this corresponds to a beam reach in which sail 20 is sheeted in, as illustrated by dotted line 20", to drive the vessel forward at this 90 degree apparent wind angle.

As mentioned hereinbefore, it is only with difficulty that spinnakers can be made to drive a vessel at an apparent wind angle forward of the beam. Certainly, spinnakers cannot be used in a close-hauled situation, due to the billowing and full shape of the sail, as well as its large size. In order to come hard on to the wind, it is necessary to douse the spinnaker and to provide a jib, be it a working jib or a Genoa jib, in order to be able to point into the wind. With large Genoas such as Number 1 and Number 2, it is possible in modern racing vessels to come to within 28 degrees of the apparent wind when close-hauled.

Figure 2:
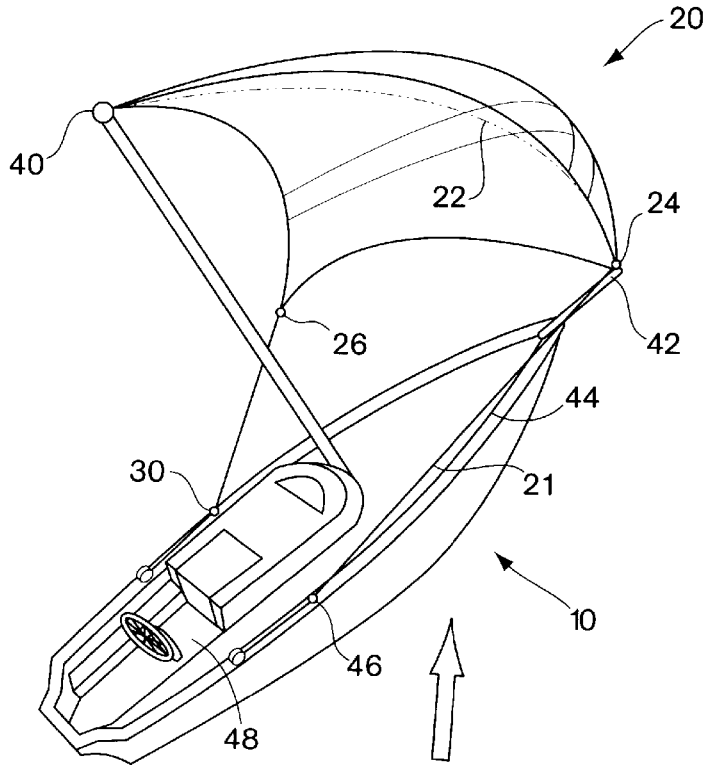
FIG. 2 is a diagrammatic illustration of a vessel flying a spinnaker from a bow sprit or forwardly projecting pole, with a tensioning line, illustrated in dotted outline, at the sail, running through a sleeve in the sail, then through either an eye in the sail or a block, and through fair leads aft to the cockpit.

Referring now to FIG. 2, in order to reconfigure the foresail, in this case the spinnaker, spinnaker 20 is provided with a tensioning line 22 between the head of the sail, here illustrated at 40, and tack 24, with the tensioning line being carried in a sleeve secured to the sail. In one embodiment, this line is turned about a block 42, and is run through fair leads 44 and 46 to a position at the cockpit 48 of vessel 10.

Figure 3:
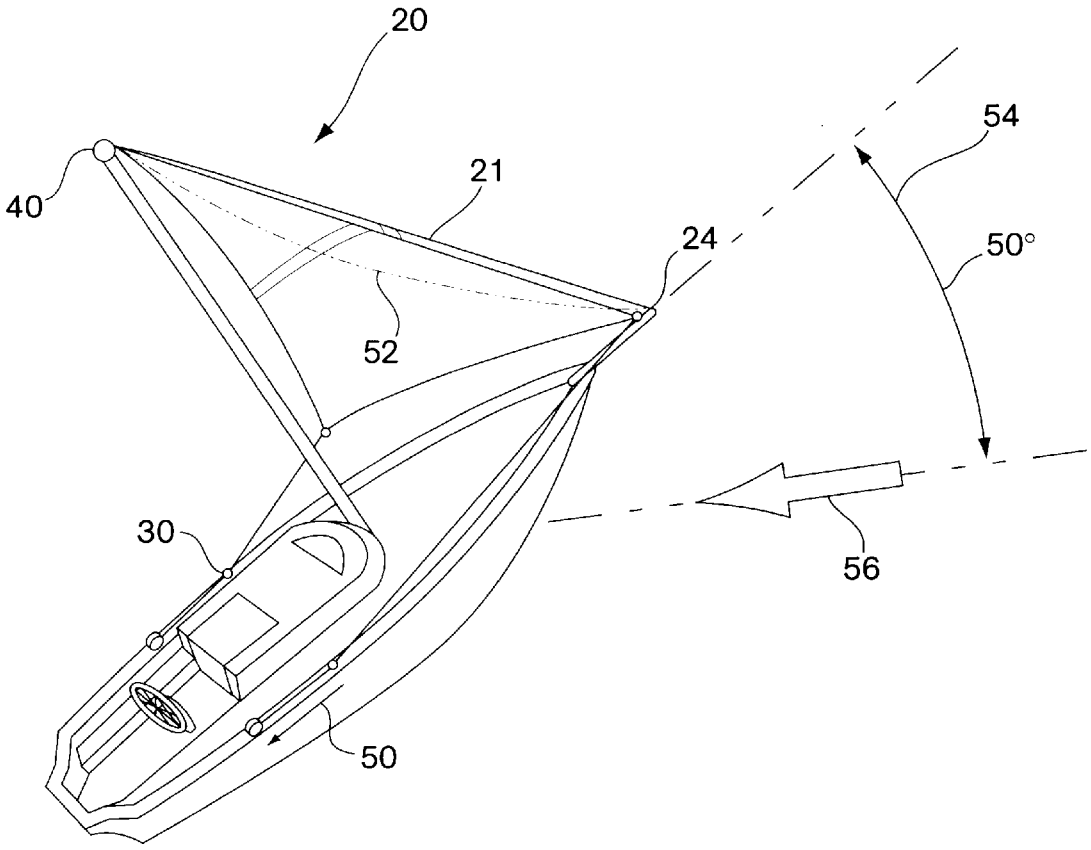
FIG. 3 is a diagrammatic illustration of the sailing vessel of FIG. 2, in which the spinnaker is made smaller and flatter due to the tensioning of the tensioning line between the head and the tack of the spinnaker, showing the folded back portion of the sail in dotted outline.

Alternatively, the tensioning line runs through an eye or grommet at the tack. As illustrated in FIG. 3, when the tension line is pulled, sail 20 takes on a smaller and flatter shape, more closely approximating a jib. Here, the tensioning line 21, when pulled in the direction of arrow 50, provides a new luff for the sail along the tension line. The material forward of the tensioning line falls backward into the leeward side of sail 20, as illustrated by dotted line 52. During the tensioning process, a new, relatively rigid luff is formed, which permits the sail to be sheeted in at winch 30 to a position appropriate for close-hauled operation. As illustrated by double-ended arrow 54, the apparent wind angle of the wind 56 is 50 degrees, a sailing point not achievable with asymmetric spinnakers in the past.

Referring now to FIG. 4, a spinnaker 60 is shown having a sleeve 62 through with a tensioning line 64 is attached to the head 66 of the sail and runs down through a grommet 68 at the tack of the sail and thence to tensioning apparatus aboard the vessel. As can be seen in this diagram, the sail is in its big, full mode, in which the foot 69 is relatively curved.

Figure 5:
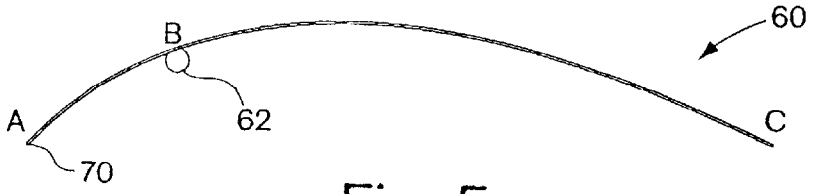
FIG. 5 is a cross-sectional view along lines A–C, indicating the position of the sleeve for the tensioning line, and also illustrating the curvature of the spinnaker under load.

As illustrated in FIG. 5, the cross-section along section line A–C of sail 60 is illustrated in which sleeve 62 is spaced from the original luff 70 of the sail.

Referring now to FIG. 6, upon tensioning of line 64, a new luff 70' is formed along the tensioning line, with the original luff and material aft of it folding back to leeward, as illustrated by dotted line 72.

In cross section, as illustrated by section lines B-C, sail 60 is considerably flatter than the shape illustrated in FIG. 5, and is considerably smaller in area.

What should be noted is that the original luff material, here illustrated at 76, folds back from line 64 and lies against the leeward portion of sail 60, where it is held in place from flapping by the aerodynamic forces on either side of sail 60 as the vessel moves to windward.

It is a finding of the subject invention that the sailing properties are not significantly altered by the original luff material being aerodynamically held in place at the leeward side of the sail, such that with a quick tensioning of line 64, a spinnaker is converted into a jib.

What makes the reconfiguring of a sail possible is the advent of new sail material, such as Kevlar, Spectra, Cuben fiber and other laminants which permit the tensioning of the sail and the formation of the sail through the tensioning line without having to be concerned about mis-shaping or tearing of the sail material itself.

It can therefore be seen, that while earlier nylon/dacron sail material may not have been able to maintain its shape utilizing the subject tensioning line, the presence of such stretch-resistant, lightweight materials now permits the utilization of the subject line-tensioning technique to reconfigure the foresail in the manner specified above.

Having now described a few embodiments of the invention, and some modifications and variations thereto, it should be apparent to those skilled in the art that the foregoing is merely illustrative and not limiting, having been presented by way of example only. Numerous modifications and other embodiments are within the scope of one of ordinary skill in the art, and are contemplated as falling within the scope of the invention as limited only by the appended claims and equivalents thereto.

What is claimed is:

1. A method of providing a change in the shape of a foresail from a spinnaker shape to that of a jib, comprising:

providing a spinnaker with a tensioning line from the head of the spinnaker to a position a predetermined distance from the tack thereof between the center of the foot of the spinnaker and the tack of the spinnaker, said line being in a sleeve attached to the sail between the head and foot of the spinnaker; and, pulling on the tensioning line to form a jib, with the luff thereof made rigid by the tensioned line such that the spinnaker material ahead of the tensioning line falls to leeward and lies against the portion of the sail aft of the tensioning line in a smooth manner to provide an appropriately shaped jib, with the tensioning line serving as a forestay to maintain the luff thereof in position, whereby a single sail can be made to function as a spinnaker and a jib.

2. A method of claim 1, wherein the spinnaker is an asymmetric spinnaker.

3. The method f claim 1, wherein the predetermined distance of the sleeve from the tack is zero, placing the lower end of the sleeve at the tack of the spinnaker.

4. The method of claim 1, wherein the size of the jib is determined by the distance from the luff to the sleeve.

5. A system for providing a change in the shape of a foresail from a spinnaker shape to that of a jib, comprising:

a spinnaker having a sleeve attached to the sail between the head of said spinnaker and a position a predetermined distance from the tack between the center of the foot of the spinnaker and the tack of the spinnaker, and a tensioning line in said sleeve, such that tensioning said tensioning line permits the formation of a jib, with the spinnaker material ahead of the tensioning line falling to leeward and lying against the portion of the sail aft of the tensioning line, said tensioning line forming a forestay to maintain the luff of said sail in position, whereby a single sail is made to function as a spinnaker and a jib.

6. A system of claim 5, wherein said spinnaker is an asymmetric spinnaker.

7. The system of claim 5, wherein the predetermined distance of said sleeve from said tack is zero, placing the lower end of said sleeve at the tack of said spinnaker.

8. The system of claim 5, wherein when said line is untensioned said sail has an initial luff and, wherein the size of said jib is determined by the distance from said initial luff to said sleeve.

9. The system of claim 5, wherein said spinnaker has a grommet at the end of said sleeve opposite the head of said spinnaker, with said tensioning line running through said grommet.

10. A re-configurable sail comprising:

a foresail having a head, a luff, a tack and a clew, said foresail being shaped as a spinnaker;

a sleeve in said foresail from the head thereof and running aft of the luff of said foresail to a position a predetermined distance from said tack; and, a tensioning line affixed at one end to the head of said foresail and running through said sleeve to the end of said sleeve opposite the end at the head of the said foresail, such that tensioning of said tensioning line while under sail forms a forestay to provide a new luff and causes the sail material ahead of said tensioning line to fall to leeward of said sail from said new luff and come to rest adjacent the leeward side of said sail to permit changing the shape of said foresail from a spinnaker to a jib.

11. The sail of claim 10 wherein said predetermined distance is zero.

* * * * *